US006322337B1

(12) United States Patent
Bensley et al.

(10) Patent No.: US 6,322,337 B1
(45) **Date of Patent: *Nov. 27, 2001**

(54) LIQUID DISPENSING SYSTEMS AND METHODS

(75) Inventors: Douglas S. Bensley; John E. Barney; Frank Dimaggio, all of Springfield; Mark Tanny, Brownsville, all of VT (US); Dikran Babikian, Millbrae, CA (US)

(73) Assignees: Ivek Corporation, North Springfield, VT (US); Silicon Valley Group, Inc., San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,851

(22) Filed: Jul. 24, 1999

(51) Int. Cl.[7] ..... F04B 7/00
(52) U.S. Cl. ..... 417/519
(58) Field of Search ..... 417/519, 502, 417/503, 504, 291

(56) References Cited

U.S. PATENT DOCUMENTS

| | | | | |
|---|---|---|---|---|
| 5,044,889 | * | 9/1991 | Pinkerton | 417/53 |
| 5,312,233 | * | 5/1994 | Tanny et al. | 417/316 |
| 5,863,187 | * | 1/1999 | Bensley et al. | 417/218 |
| 5,996,620 | * | 12/1999 | Bensley | 137/554 |

* cited by examiner

*Primary Examiner*—Teresa Walberg
*Assistant Examiner*—Vinod D Patel
(74) *Attorney, Agent, or Firm*—Robert Moll; @Patent Planet

(57) ABSTRACT

The present invention provides systems and methods of dispensing liquids. In one embodiment, the system includes a pump with a removable pump module with at least one displacement piston and at least one piston valve. A motor and base assembly provide the supporting components of the pump which can be used in environments where precise small volumes of ultra-pure liquids must be transferred from a reservoir to a point of use. The preferred embodiment of the system prevents contaminants and air bubbles from being introduced into the liquid to be dispensed by placing a filter across the discharge line downstream from the pump, and providing a separate drawback line for performing the drawback of the liquid in the dispensing nozzle.

14 Claims, 6 Drawing Sheets

VIEW A-A

LIQUID DISPENSING SYSTEMS AND METHODS

BACKGROUND OF THE INVENTION

This invention relates to dispensing liquids in precise volumes and more particularly to the transfer of liquid from a reservoir to a point of use by a pump having a displacement piston and a rotating piston valve communicating with one of a plurality of liquid ports.

The ability to deliver precise small volume amounts of liquids without introduction of contaminants is quite important in the manufacture of many products, especially in the electronics industry. A semiconductor foundry has several principal areas—metrology, lithography, and track where resist and developer must be rapidly and precisely dispensed. More specifically, photolithography requires precise repeatable delivery of photoresist and developer at different rates such as volumes of 0–10 ml±0.1%, repeatable to within ±0.1 volume % with substantially no contaminants or air bubbles. If these requirements cannot be met consistently, it adversely impacts the yield of the process. See, e.g., Chang & Sze, *ULSI Technology* (1996) hereby incorporated by reference.

The semiconductor industry provides, for example, different pumps such as piston pumps, diaphragm pumps, and peristalic pumps to transfer liquid from a liquid reservoir to a dispense nozzle above a silicon wafer in a spin station. After the liquid is dispensed any residual liquid left in the tip of the nozzle is drawn back slightly so that the resulting meniscus force prevents uncontrolled drips on the wafer and the wafer is rotated at high rpm to spread the liquid uniformly over the wafer.

The liquid dispensing system must also provide a filter to capture contaminants which might be introduced in the liquid dispensed. When the filter is upstream of the pump, it captures the contaminants generated for example at the reservoir and/or the reservoir line leading to the pump but will be ineffective at capturing contaminants generated in the pump which then enter the liquid dispensed on the wafer. When the filter is downstream of the pump, the filter may capture pump generated contaminants but may still release air bubbles and contaminants into the dispensing system during draw back mode when the liquid reverses direction through the filter which tends to dislodge some of the particles caught in the filter.

SUMMARY OF THE INVENTION

The invention provides systems and methods of rapid delivery of liquids in precise volumes and with accuracy. The systems include a pump operating under the positive displacement principle. The pump includes at least one displacement piston, and at least one piston valve with a fluid slot, where the pistons in a cylinder define a pumping chamber. In general the displacement piston travels back and forth in the cylinder, producing suction, and discharging pumping action. The distance traveled by the displacement piston determines the dispensing volume of the pumping chamber and the direction of travel determines the direction of flow through any cylinder port. The piston valve rotates to align the fluid slot with a given cylinder port to communicate with the pumping chamber.

In refill mode, the piston valve rotates until the slot aligns with the intake port of the cylinder so the pumping chamber can communicate with the reservoir. The displacement piston retracts in the cylinder, expanding the pumping chamber, and drawing liquid from the reservoir though the intake port and into the pumping chamber. In dispense mode, the piston valve rotates closing the intake port so that the pumping chamber no longer communicates with the reservoir until the piston valve slot aligns with the discharge port out of the pumping chamber. The displacement piston slides forward, reducing the volume of the pumping chamber, expelling liquid through the discharge port.

In one embodiment, the piston valve includes a plurality of ports, such as an intake port, a discharge port, and a drawback port to permit precise delivery of liquids through a dispense nozzle without introducing contaminants, air bubbles, or liquid dripping. In drawback mode, in this embodiment, after the discharge step, the piston valve rotates closing the discharge port and the piston valve slot aligns with the drawback port, then the displacement piston slides back, expanding the volume of the pumping chamber, drawing liquid back in the dispense nozzle. The embodiment of the system also prevents contaminants and air bubbles from being introduced into the liquid to be dispensed from the nozzle by placing a filter across the discharge line downstream from the pump, and providing a separate drawback line for performing the drawback of the liquid in the dispensing nozzle so that drawback does not occur through the filter. This embodiment has special advantage in the precise control of semiconductor equipment used in dispensing liquid chemicals in ULSI technology.

DETAILED DESCRIPTION OF THE PREFERRED EMBODIMENTS

Figure 1:
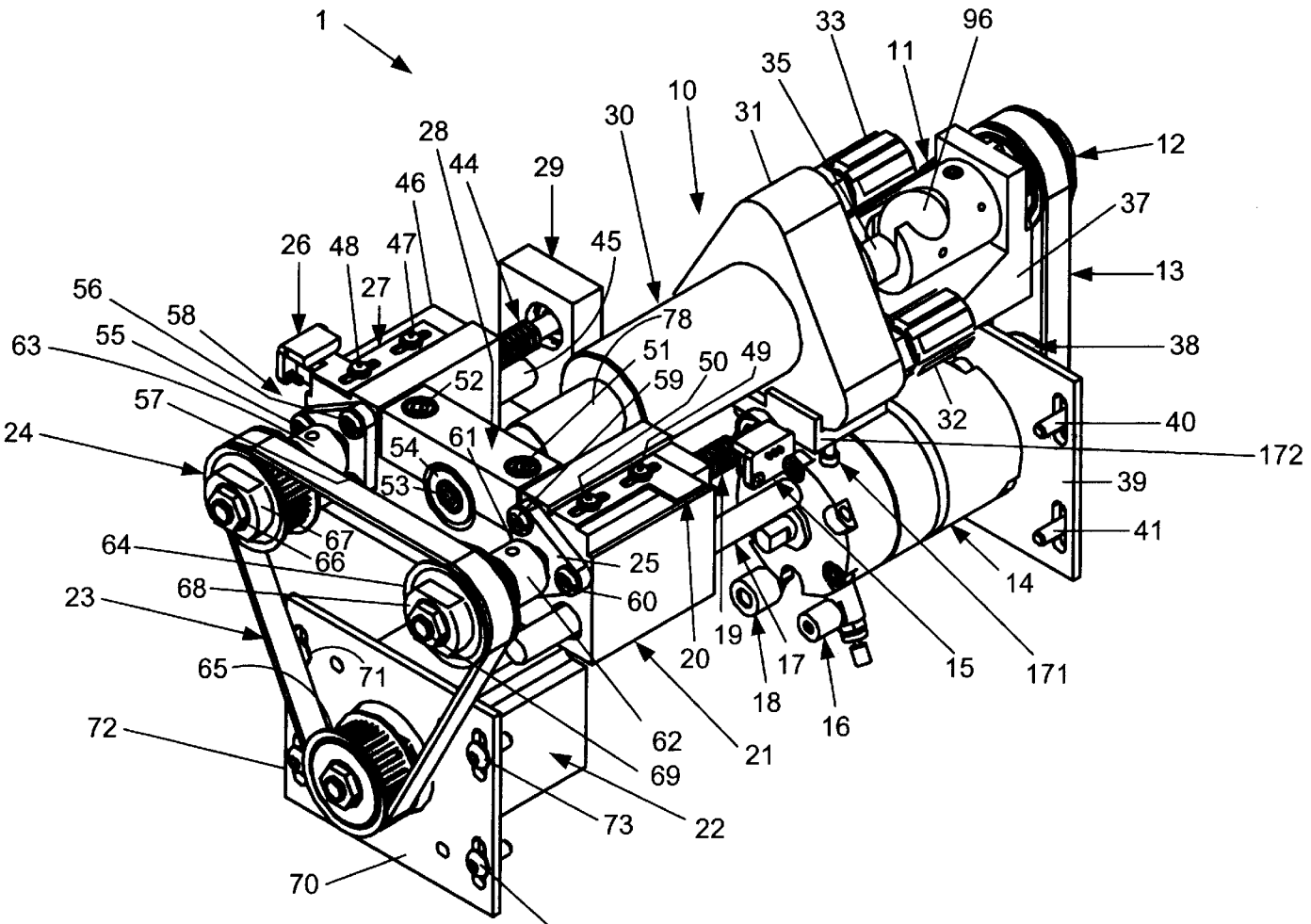
FIG. 1 is a perspective drawing of an embodiment of the pump, and illustrates the assembled pump including the pump module and the motor and base assembly.
Figure 6:
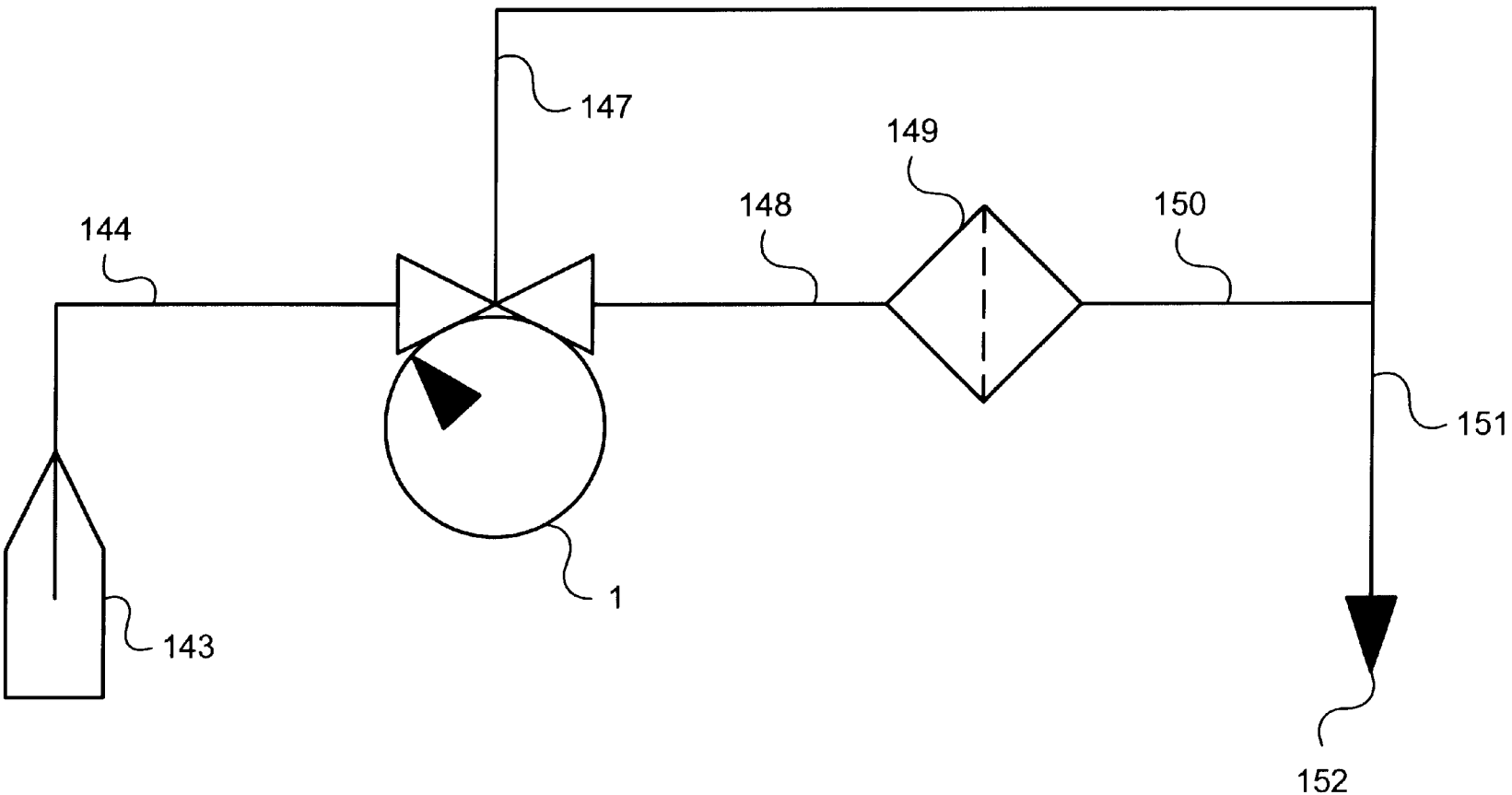
FIG. 6 is a schematic diagram illustrating the basic components of one embodiment of the precision liquid dispensing system.

FIG. 1 illustrates an embodiment of a pump 1 capable of transferring precise small volumes, e.g., 0–10 ml, of a liquid from a liquid reservoir to a dispense nozzle. The pump 1 can be used in a system such as that depicted in FIG. 6 to deliver resist and developer to semiconductor wafers. As shown in FIG. 6, the components of the system include a liquid supply reservoir 143, a liquid supply line 144, a three-port pump 1, an upstream discharge line 148, a filter 149, a downstream discharge line 150, a dispense line 151, a dispense nozzle 152, and a drawback line 147. The liquid reservoir 143 can be a variety of well known reservoirs, the liquid lines are preferably of Teflon, the tube hardware and fittings can be Parker, Parabound Adaptor, Paraflare x Pipe BA-4F4, one suitable filter 149 is the Pall model no. MCD9116UFTEH, and the materials of the pump 1 will be described in detail below.

In operation, the pump 1 and the liquid lines are preferably charged with liquid. In dispensing mode, the pump 1 displaces liquid through the upstream discharge line 148, the filter 149, the downstream discharge line 150, the dispense line 151, and out of the dispense nozzle 152 onto the wafer. In drawback mode, occurring preferably a short time after the dispense mode, the three-port pump 1 valve is actuated to communicate with the drawback line 147 and the displacement piston in the cylinder of pump 1 reverses direction to enable drip-free dispense by drawing the liquid back inside the nozzle 152 through the drawback line 147 avoiding the need to reverse the flow through the filter 149. This feature helps to prevent contaminants from being dislodged from the filter 149. In purge mode, the system can use the drawback line 147 to prime any air out of the nozzle 152 also without going through the filter 149. This feature reduces air bubbles from being introduced into the liquid dispensed. Alteratively, the pump 1 might add a fourth port to allow purge of air from entering into the liquid supply reservoir 143 through a liquid purge back line (not shown) to conserve resist.

Figure 2:
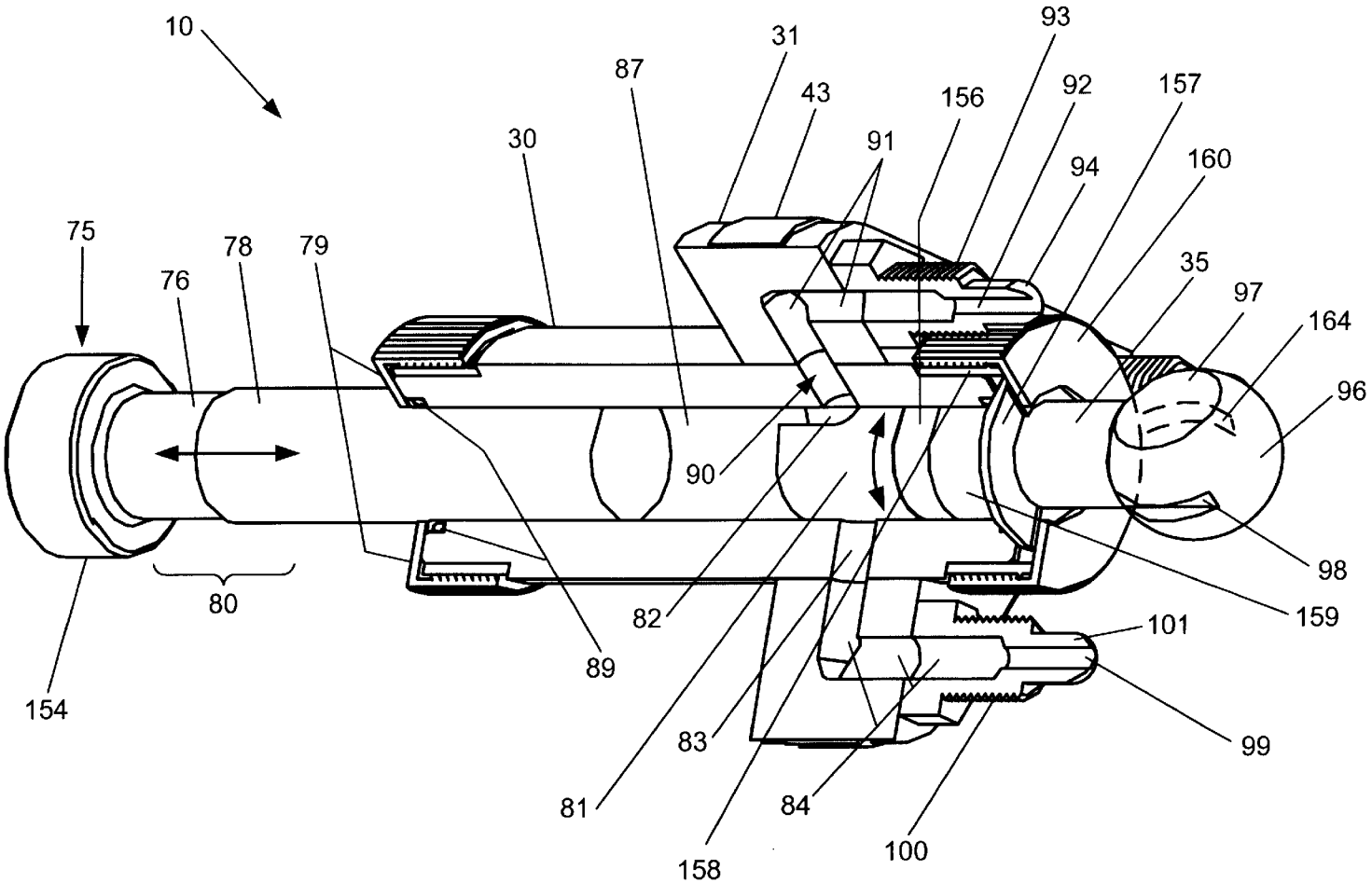
FIG. 2 is a partial cross-section taken along A—A of FIG. 5 and a perspective drawing of an embodiment of the pump module.

Referring again to the embodiment shown in FIG. 1, the pump 1 includes a pump module, a motor and base assembly, and an electronic controller (not shown), and operates by the positive displacement principle. As shown in FIG. 2, the displacement piston 80 pumps the liquid by traveling back and forth in a cylinder liner 30, as indicated by the arrows, producing suction and discharging action. The distance traveled by the displacement piston 80 in the cylinder liner 30 is proportional to the volume of the pumping chamber 87. For liquid intake the piston valve 81 rotates so that the fluid slot 82 aligns with an intake port 85 (FIG. 5) so that the pumping chamber 87 communicates with the liquid reservoir 143 (FIG. 6). The displacement piston 80 retracts in the cylinder liner 30, expanding the pumping chamber 87, drawing liquid from the reservoir 143 (FIG. 6) though the intake port 85 (FIG. 5) and into the pumping chamber 87. The piston valve 81 rotates closing the intake port 85 (FIG. 5) so that the pumping chamber 87 no longer communicates with the reservoir 143 (FIG. 6). To discharge the liquid drawn into the pumping chamber 87, the piston valve 81 rotates to align the fluid slot 82 with the discharge port 83, and the displacement piston 80 extends into the cylinder liner 30, expelling liquid from pumping chamber 87 through the discharge port 83. To draw back liquid in the discharge line, the displacement piston 80 can retract immediately after the discharge step. However, in the preferred embodiment, the pump 1 draws back the liquid in the dispense nozzle 152 (FIG. 6) by rotating the piston valve 81 to align the fluid slot 82 with a drawback port 90, and then retracting the displacement piston 80.

Figure 3:
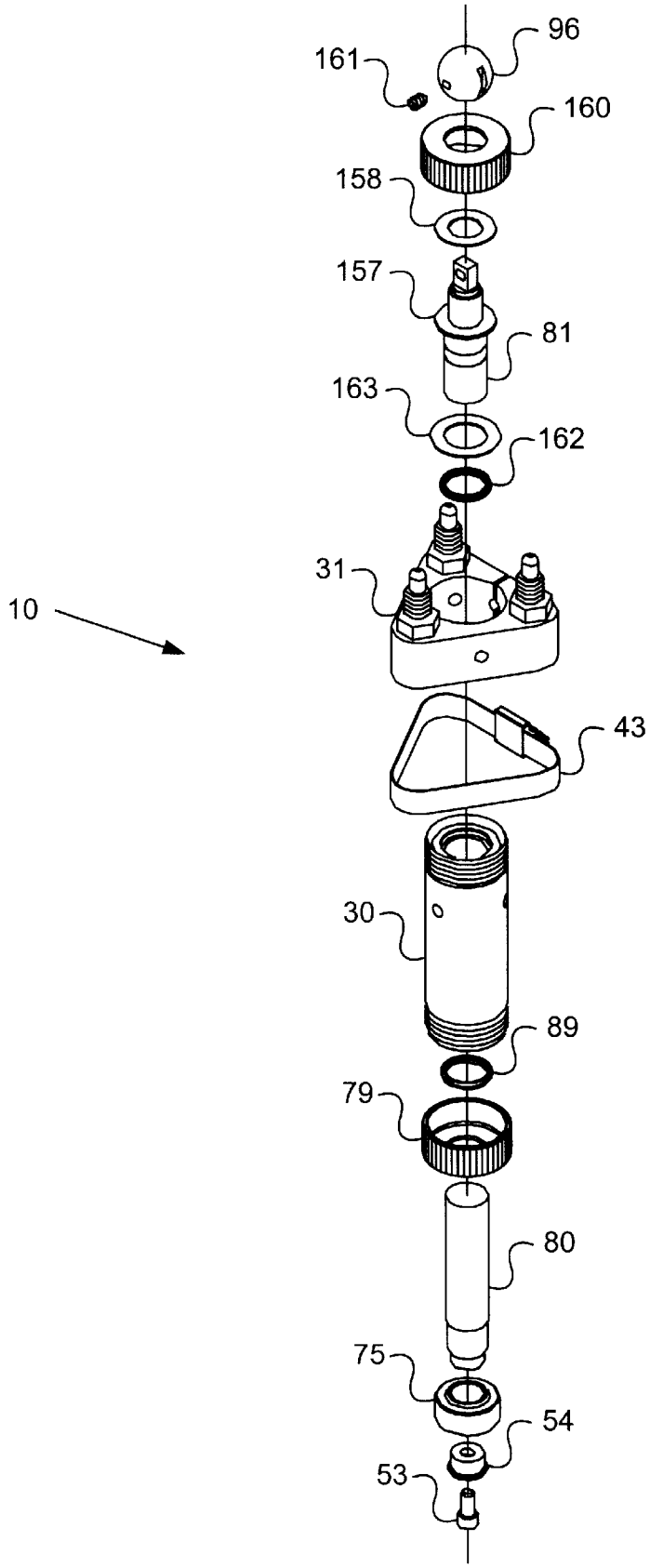
FIG. 3 is an exploded view of the components of the pump module shown in FIG. 2.

FIG. 3 is an exploded view of the parts making up the pump module 10. A valve bearing ball 96 is attached on a neck 35 (FIG. 1) of the piston valve 81 by a cone point socket set screw 161. To form a liquid seal the pump module 10 preferably provides a cylinder end cap 160, a Teflon thrust washer 158, a flange 157 on the piston valve 81, a Teflon thrust washer 163, and a lip seal 162. A conventional clamp band 43 is provided to hold a port fitting case 31 on the cylinder liner 30. As shown in FIG. 1, a support 172, preferably including a spacer 171, is located under the port fitting case 31 to prevent rotation of the port fitting case 31 from torque produced by rotation of the motor 14. The port fitting case 31 is preferably made of Teflon. Another liquid seal is provided by assembly of a cylinder end cap 79, a lip seal 89, and a cylinder liner 30. A socket head cap screw 53 is provided which is inserted into a spherical bearing retainer 54 and a spherical bearing 75 with a race 154 (FIG. 2) and into the end of the displacement piston 80 to hold the retainer 54, the bearing 75, and the displacement piston 80 in fixed relationship with each other.

When the various parts shown in FIG. 3 are assembled, the pump module 10 appears as shown in FIG. 2. FIG. 2 illustrates that the fluid seal includes a cylinder end cap 79 holding a lip seal 89 against the cylinder liner 30 and a contact surface 78 of the displacement piston 80. FIG. 2 illustrates when the fluid slot 82 described earlier is aligned with the drawback port 90. The clamp band 43 holds the port fitting case 31 to the cylinder liner 30 so that the drawback port 90 aligns with the L-shaped port 91 of the port fitting case 31. Similarly, the clamp band 43 holds the port fitting case 31 to the cylinder liner 30 so that the discharge port 83 aligns with the L-shaped port 84. The L-shaped port 91 narrows to a passage 92 in a male connector 94, and threads 93 engage a twist tight collar 33 (FIG. 1). Likewise, the L-shaped port 84 narrows to a passage 99 of a male connector 101 and threads 100 engage a twist tight collar 32 (FIG. 1). Again, the fluid seal at the valve bearing ball 96 end preferably uses the parts discussed earlier in connection with FIG. 3. The piston valve 81 includes a relief band 156 which is slightly smaller in diameter than the rest of piston valve 81 to permit liquid to enter in the gap to prevent the curing of the liquid under the pressures and temperatures created by the tight fit and movement of the piston valve 81. The piston valve 81 also includes an inner neck 159, an outer neck 35 and is attached to the valve bearing ball 96 which has two slots 98 and 164 and a flat surface 97 for reasons discussed below.

FIG. 2 also shows that the spherical bearing 75 is held to a piston end cap 76 preferably made of stainless steel 316. The piston end cap 76 is heat shrunk or glued on the end of the displacement piston 80 as shown in FIGS. 2–3. The displacement piston 80, the piston valve 81, and the cylinder liner 30 are preferably made of aluminum oxide or polished zirconia (YTZP) but can be also made of another suitable ceramic, a stainless steel, Delrin™, Tefzel™, or Kynar™. The advantage of aluminum oxide is it may not require lubrication beyond that provided by the liquid being dispensed or metered, it is extremely hard and resists abrasion, it exhibits little wear after many cycles, it is chemically stable, and it allows precision machining and diamond tooling with close running fits (100 millionths of an inch). Aluminum oxide's properties of low friction, hardness, and stability allow the pump module 10 to be primarily sealed by close clearance of the pistons 80, 81, and the cylinder liner 30. This means no compliant seals may be needed which eliminates a set of parts which frequently fail and require replacement in conventional pumps.

As shown in FIGS. 1–2, the pump 1 includes motors 14 and 22 for driving the pump module 10. First, a stepper motor 22 drives the displacement piston 80 by rotating a bottom pulley 65 coupled by a drive belt 23 to a set of pulleys 24 and 64. In alternative embodiments, the motor 22 can be a servo motor or another suitable positioning motor. The pulleys contact the drive belt 23 with sufficient friction and tension to prevent slippage between the pulleys and the belt. One suitable drive belt is the Breco-flex 10T5/390. A suitable pulley is the LS21T5/20-2 made by Breco-flex. The tension of the drive belt 23 can be adjusted by loosening bolts 71–74 residing in the vertical slots of rigid plate 70 so that the pulley 65 can move up to reduce or down to increase the tension of the drive belt 23. Thus, the rigid plate 70 provides an adjustable support structure for mounting the pulley 65 and the stepper motor 22.

In a preferred embodiment if the stepper motor 22 rotates, the drive belt 23 transfers that force to the pulleys 24 and 64 which rotate precision lead screws 44 and 19. Eastern Air Devices, Inc., motor series LH2318 together with Intelligent Motion Systems, Inc. Model IM483 drive electronics provide a compatible motor and controller combination for this purpose. One end of precision lead screw 44 attaches to the pulley 24 and the other end rotates in a lead screw and linear shaft bearing block 29. One end of precision lead screw 19 attaches to the pulley 64 and the other end rotates in a lead screw and linear shaft bearing block like block 29 but not shown to expose other parts to view.

Spacers 63 and 62 space pulleys 24 and 64 from triangular shaped lead nuts 58 and 25. Lead nut 58 is fixed to a displacement slide block 46 by bolt 57 hidden by drive belt 23 in FIG. 1, a bolt 55 partially hidden by spacer 63 in FIG. 1, and a bolt 56. The lead nut 25 is bolted to a displacement slide block 21 by bolt 61 hidden by the spacer 62, a bolt 59, and a bolt 60. A pair of parallel linear bearing shafts 17 and 45 guide the displacement slide blocks 21 and 46. A piston coupling 28 is attached by bolts 51 and 52 to the displacement slide blocks 21 and 46 and to the displacement piston 80 by the socket head cap screw 53, the retainer 54, and the bearing 75 described earlier. Thus, the piston coupling 28, and the displacement slide blocks 21 and 46 move as a unit to drive the displacement piston 80 in and out of the cylinder liner 30 as the precision lead screws 44 and 19 rotate and engage the threads of the lead nut 58 and the lead nut 25, respectively. Preferably, the displacement slide blocks 21 and 46 have holes which are not threaded and therefore do not engage either the threads of the precision lead screw or bind the linear bearing shafts.

An adjustable flag 20 is held by bolts 49 and 50 to the displacement slide block 21 and overlaps an adjacent piston extended position sensor 15 when the displacement piston 80 fully extends into the cylinder liner 30. Similarly, an adjustable flag 27 is held by bolts 47 and 48 to the displacement slide block 46 and overlaps an adjacent piston retracted position sensor 26 when the displacement piston 80 fully retracts in the cylinder liner 30. One suitable sensor uses the Hall effect to detect when the metal flag interrupts a magnetic field emanating from the sensor. Another uses the photoelectric effect where a object fixed to the displacement block serves to partially or fully interrupt a light beam aimed at a photo detector. The Honeywell Microswitch 4AV series is suitable for performing this function.

FIGS. 1–2 illustrate that the pump 1 also includes a motor 14 for driving the piston valve 81 of the pump module 10 by rotating a pulley 38 coupled by a belt 13 to a pulley 12. The pulleys 12 and 38 have sufficient friction with the belt 13 to avoid slippage. The motor 14 is preferably an air-powered rotary indexer because it quickly rotates the fluid slot 82 into alignment with a port when commanded by a conventional controller. In such a motor such as that manufactured by SMC, for example, the NCRBI-W30-1805 series motor, pneumatic air enters input 18 and a well known ratchet-gear mechanism converts the 180 degree movements of the motor 14 into the desired angular increment, e.g., 120 degrees for a three-port embodiment as shown in FIG. 1. After an angular increment occurs the air is relieved at air exhaust 16. In alternative embodiments, the motor 14 can be a servo motor or another suitable positioning motor. Preferably, a conventional controller using advanced solid-state electronics with microprocessor technology and sensors can be used to control the pump 1, including the motors 22 and 14 to actuate the movement of the displacement piston 80 and the piston valve 81 at appropriate velocities, distances, and times.

A suitable drive belt 13 is the Breco-flex 10T5/390 and one suitable pulley is the LS21T5/20-2 made by Breco-flex. The tension of the drive belt 13 can be easily adjusted by loosening bolts such as bolts 40–41 in the vertical slots at corners of a rigid plate 39 and moving the rigid plate 39 supporting the pulley 38 up to reduce the tension or down to increase the tension of the drive belt 13. Thus, the rigid plate 39 provides an adjustable support structure for mounting the pulley 38 and the motor 14. A L-shaped bracket 37 includes a conventional sealed bearing for supporting the shaft of the pulley 12 and an universal coupling 11 shown in FIG. 1.

Figure 4:
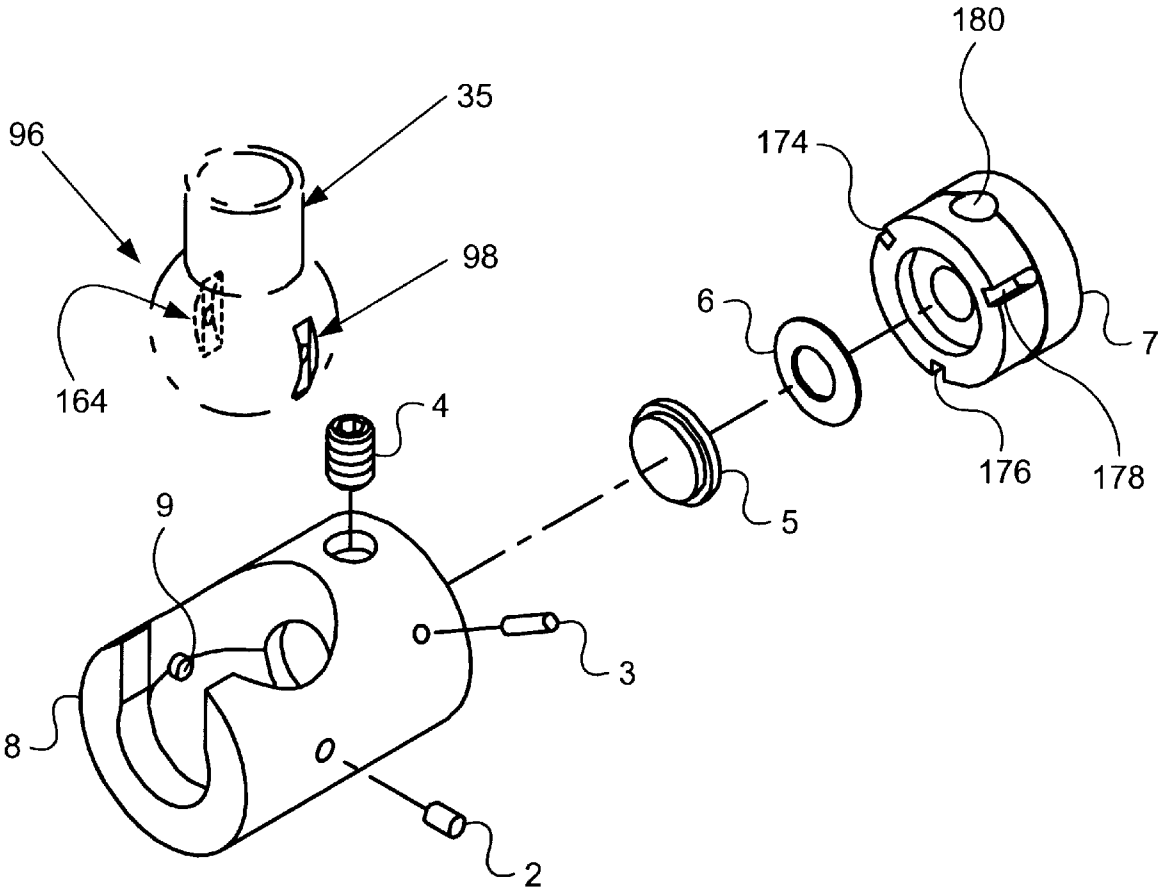
FIG. 4 is an exploded perspective view illustrating a preferred universal coupling for the piston valve.

The universal coupling 11 eliminates the problem of how to exactly align the axis of the pulley 12 with that of the piston valve 81. The location of the universal coupling 11 in the pump 1 is best shown in FIG. 1, but the details are in FIG. 4. As shown in FIG. 4, an exploded view, the universal coupling 11 includes a coupling body 8 with a receptacle for the valve bearing ball 96, and a set of pins 2 and 9 to hold the valve bearing ball 96 in the receptacle. Pin 2 engages slot 98 and pin 9 engages slot 164 on valve bearing ball 96 to provide a positive rotational coupling. Thus, the pump module 10 is held by the universal coupling 11 on one end and by the piston coupling 28 on the other. This permits the pump module 10 to be quickly removed from the rest of the pump 1 for cleaning or autoclaving. For example, to remove the pump module 10, one would remove piston coupling 28, then pivot the pump module 10 approximately 90 degrees with respect to the operational axis on pins 2 and 9 to the dotted line position shown in FIG. 4. When slots 98 and 164 are aligned perpendicular to coupling 8, the pump module 10 can be removed. To assist in that removal, the flat surface 97 of the valve bearing ball 96 provides clearance to the button 5 in universal coupling 11 when the pump module 10 is pivoted 90 degrees.

A biasing means holds the valve bearing ball 96 in place during operation and includes a button 5 biased by a Belleville washer 6 (i.e., domed shaped for spring action) and held by a retainer washer 7. To install the biasing means in the coupling body 8 the following steps are taken. The Belleville washer 6 is inserted in the retainer washer 7, the button 5 is placed on the washer 6, and preferably three dowel pins such as dowel pin 3 are partially inserted in holes 120 degrees apart to protrude in the coupling body 8 to guide the retainer washer 7 along corresponding slots 174, 176, and 178. When each pin hits the end of its slot, where a hole exists, the pin can be driven into the hole of the retainer washer 7. Because of the tight fit and flared shape of the pins, this technique firmly attaches the retainer washer 7 in the coupling body 8. A cone point set screw 4 travels through the larger top hole in coupling body 8 and engages in threaded hole 180 in the retainer washer 7, acting to fix the coupling body 8 to the shaft of the pulley 12. As shown in FIG. 1, conventional spacers (not shown) maintain pulleys 12 and 38 at an appropriate distance from respectively the L-shaped bracket 37 and the plate 39.

Figure 5:
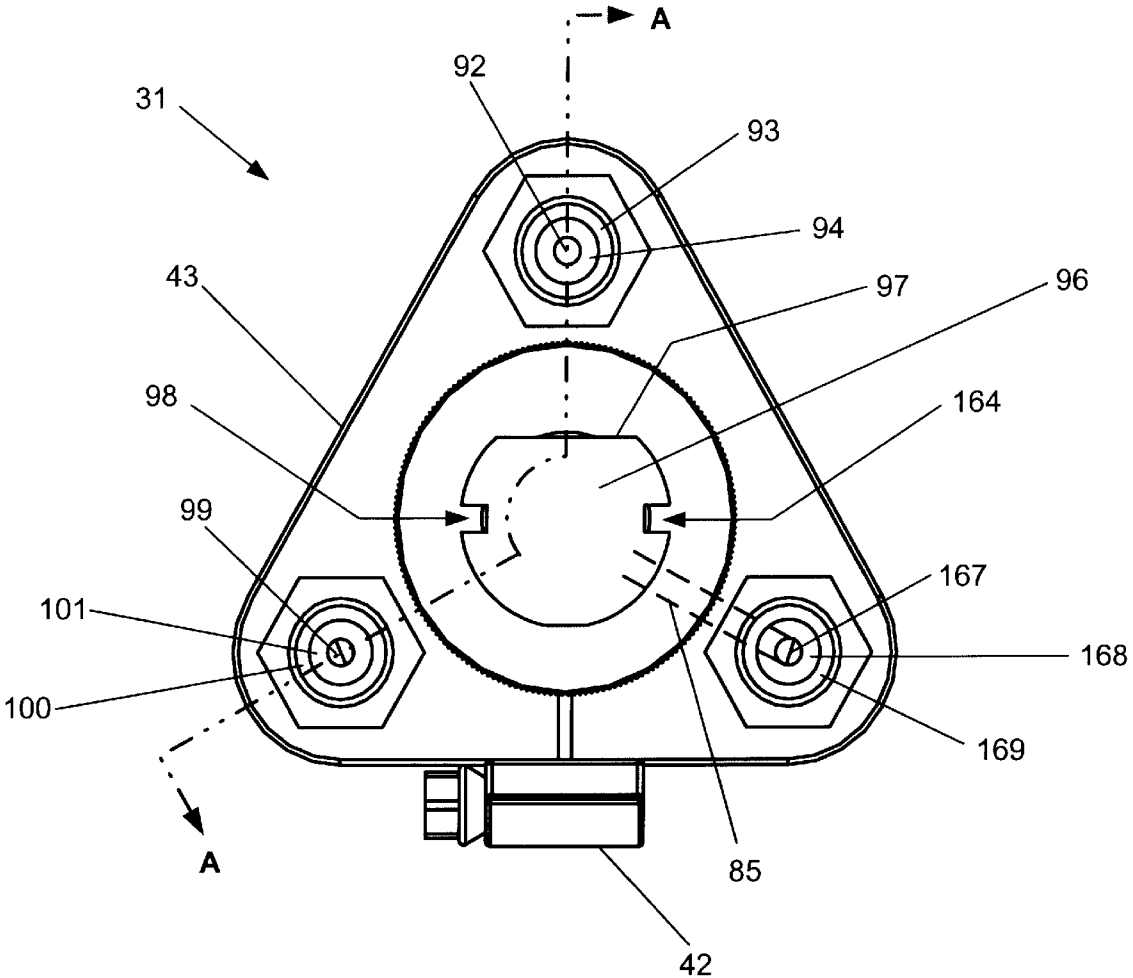
FIG. 5 is an end view of the port fitting case, the valve bearing ball, the three ports of the port fitting case, and a clamp band around the port fitting case.

FIG. 5 is a detail end view of one embodiment of a three-port case fitting 31. It shows where the cross-section A—A is taken in the embodiment illustrated in FIG. 2 and can be understood in conjunction with embodiments illustrated in FIGS. 1–2. In those embodiments, the top port dedicated to a drawback line, includes a male connector 94 defining a passage 92 and having threads 93. The bottom right port, almost completely hidden in FIG. 2, and dedicated to an intake line, includes a male connector 168 defining a passage 167 and with threads 169. The bottom right port communicates with the fluid slot 82 by the port 85 represented by dotted lines. The bottom left port, dedicated to a discharge line, includes a male connector 101 defining a passage 99 and with threads 100. FIG. 5 also illustrates an embodiment for the valve bearing ball 96 including the flat surface 97 as well as the slots 98 and 164 for engaging pins 2 and 9 of the universal coupling 11 as discussed earlier.

Any given port can function as an intake or a discharge liquid depending on whether the displacement piston 80 retracts or extends into the cylinder liner 30 after alignment. Further, the port fitting case 31 is not limited to three ports as illustrated but could be a plurality of ports depending on the application. Accordingly, the pump module 10 could have multiple outputs and/or multiple inputs and/or multiple drawbacks and/or purge lines. In addition, a pump 1 could have a plurality of pump modules 10 disposed in parallel each having a stepper motor 22 or driven by the same stepper motor 22 and each having their own piston valve 81 and motor 14 or driven by the same motor 14. Of course, this permits the compact pumping of different liquid chemicals with isolation between the chemicals. The design of the piston valve 81 dispenses and meters liquid without any secondary mechanism such as check valves which allows for longer life, higher reliability, and greater accuracy.

What is claimed:

1. A liquid dispensing pump system, comprising:

a pump module including a displacement piston and a piston valve disposed in a cylinder and defining a pumping chamber, wherein the displacement piston travels back and forth in the cylinder, producing suction, and discharging pumping action, a port case fitting with a plurality of ports able to communicate one at a time with a fluid slot in the piston valve based on rotation of the piston valve, and the direction of travel of the displacement piston determines the direction of flow out of any port;

means for driving the displacement piston back and forth in the cylinder; means for rotating the piston valve in the cylinder without rotating the displacement piston so that the fluid slot of the piston valve communicates with one of the plurality of ports in the port case fitting; and means for supporting the pump module, the means for driving the displacement piston, and the means for rotating the piston valve.

2. An apparatus for pumping fluid, comprising:

a pump module, including a cylinder liner with a plurality of ports, a displacement piston slidably disposed in the cylinder liner, a separate piston valve with a fluid slot rotatably disposed in the cylinder liner, wherein the displacement piston and the piston valve and cylinder liner define a pumping chamber; and a first motor coupled to means for driving the displacement piston back and forth;

a second motor coupled to means for rotating the piston valve to align the fluid slot with each of the liner ports; and a base supporting the pump module, the first motor, and the second motor.

3. The apparatus of 2, further comprising a controller coupled to the first motor and second motors during refill, discharge, and drawback modes to actuate:

the displacement piston to expand the volume of the pumping chamber and to rotate the fluid slot of the piston valve so the pumping chamber only communicates with an intake port, the displacement piston to reduce the volume of the pumping chamber and to rotate the fluid slot of the piston valve so the pumping chamber only communicates with a discharge port, and the displacement piston to reduce the volume of the pumping chamber and to rotate the fluid slot of the piston valve so the pumping chamber only communicates with a drawback port.

4. The apparatus of claim 2, wherein the means for driving the displacement piston back and forth includes a plurality of lead screws parallel to the pump module, a plurality of displacement slide blocks, each block having a lead screw hole parallel to the pump module, a member joined to the displacement slide blocks holding the pump module, and wherein each of the plurality of lead screw resides in a lead screw hole in one of the displacement slide blocks.

5. The apparatus of claim 4, wherein the first motor is coupled to the plurality of lead screws by a plurality of pulleys, each pulley being attached to one lead screw or the first motor, and wherein the pulleys rotate together by a belt contacting each pulley for movement of the displacement piston back and forth.

6. The apparatus of claim 4, further comprising a plurality of linear bearing shafts, wherein each of the plurality of linear bearing shafts resides in a linear bearing shaft hole in one of the displacement slide blocks.

7. A pump, comprising:

a pump module, including a cylinder liner with ports, a displacement piston in the cylinder liner, a piston valve disposed in the cylinder liner, wherein the piston valve includes a fluid slot and is fixed to a valve bearing ball;

a first motor for driving the displacement piston;

a second motor for rotating the valve bearing ball to align the fluid slot with one of the ports; and a base supporting the pump module, the first motor, and the second motor.

8. The apparatus of claim 7, wherein the second motor is an actuator having a shaft, rotating forward or in reverse within a first angle, wherein the means for rotating the piston valve includes means for converting the forward or reverse rotation to a single-direction rotation of the piston valve within a second angle, wherein the first angle is greater than the second angle.

9. A liquid dispensing system, comprising:

a liquid reservoir;

a pump including an intake, a discharge, and a drawback port, wherein the pump is disposed downstream of the reservoir;

a filter downstream of the pump;

a supply line communicating with the reservoir and the intake port of the pump;

an upstream discharge line communicating with the discharge port of the pump and the upstream end of the filter;

a dispense line;

a downstream discharge line communicating with the downstream end of the filter and the dispense line; and a drawback line communicating with the drawback port of the pump and the dispense line.

10. A pump module, comprising:

a cylinder liner with a plurality of ports;

a port fitting case with ports aligned with the plurality of ports;

a displacement piston slidably disposed in the cylinder liner; and a piston valve with a fluid slot, wherein the piston valve is rotatably disposed in the cylinder liner such that the fluid slot can rotate to align the plurality of ports, and wherein the piston valve includes a valve bearing ball disposed outside the cylinder liner.

11. The pump module of claim 10, further comprising first and second cylinder end caps with lip seals for sealing each end of the cylinder liner.

12. The pump module of claim 10, wherein the port fitting case is attached to the cylinder liner and provides ports leading to external connectors for each of the plurality of ports.

13. The pump module of claim 10, wherein the piston valve includes a relief band slightly smaller in diameter than the rest of the piston valve to permit liquid to enter in the gap between the piston valve and the cylinder liner to prevent curing of liquid.

14. The pump module of claim 10, wherein the piston valve includes an inner neck at least partially within the cylinder liner and an outer neck attached to the valve-bearing ball, which ball has a plurality of slots and a flat surface.

* * * * *